US007152815B2

(12) United States Patent
Harris et al.

(10) Patent No.: US 7,152,815 B2
(45) Date of Patent: Dec. 26, 2006

(54) DISPENSING SYSTEM, NOZZLE AND METHOD FOR INDEPENDENTLY DISPENSING AND CONTROLLING LIQUID

(75) Inventors: Michael W. Harris, Cumming, GA (US); Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 214 days.

(21) Appl. No.: 10/860,987

(22) Filed: Jun. 4, 2004

(65) Prior Publication Data

US 2004/0256496 A1 Dec. 23, 2004

Related U.S. Application Data

(60) Provisional application No. 60/475,616, filed on Jun. 4, 2003.

(51) Int. Cl.

| | |
|---|---|
| ***B05B 1/30*** | (2006.01) |
| ***B05B 7/08*** | (2006.01) |
| ***B05B 7/10*** | (2006.01) |
| ***A62C 2/08*** | (2006.01) |
| ***A62C 5/02*** | (2006.01) |

(52) U.S. Cl. ..... 239/569; 239/548; 239/549; 239/551; 239/406; 239/8; 239/9; 239/10

(58) Field of Classification Search ..... 239/569, 239/548, 549, 551, 562, 398, 406, 407, 413, 239/417.5, 8, 9, 10

See application file for complete search history.

(56) References Cited

U.S. PATENT DOCUMENTS

| | | | | |
|---|---|---|---|---|
| 3,979,239 | A * | 9/1976 | Walsh | 438/692 |
| 4,545,529 | A * | 10/1985 | Tropeano et al. | 239/2.2 |
| 5,478,435 | A * | 12/1995 | Murphy et al. | 438/693 |
| 6,059,880 | A * | 5/2000 | Kitano et al. | 118/52 |
| 6,814,555 | B1 | 11/2004 | Allen | |

* cited by examiner

*Primary Examiner*—Davis Hwu
(74) *Attorney, Agent, or Firm*—Wood, Herron & Evans, L.L.P.

(57) ABSTRACT

A dispensing system comprising first and second valve modules each having an output for delivering a liquid under pressure, a nozzle assembly coupled to the first and second valve modules, the nozzle assembly having at least two separated, at least partially coextensive outputs respectively communicating independently with the outputs of the first and second valve modules. A nozzle assembly adapted to be coupled to first and second valve modules each having an output for delivering a liquid under pressure, the nozzle assembly having two liquid inputs and at least two separated, at least partially coextensive outputs respectively communicating independently with the two liquid inputs, and the two liquid inputs adapted to be coupled in communication with the outputs of the first and second valve modules. A method of extruding a liquid, comprising delivering the liquid to two separated, at least partially coextensive outputs of a nozzle assembly, discharging the liquid from the outputs, and combining the discharged liquid on a substrate.

18 Claims, 4 Drawing Sheets

DISPENSING SYSTEM, NOZZLE AND METHOD FOR INDEPENDENTLY DISPENSING AND CONTROLLING LIQUID

CROSS-REFERENCE TO RELATED APPLICATIONS

This application claims the benefit of U.S. Provisional Application No. 60/475,616 filed on Jun. 4, 2003, and the disclosure of which is hereby incorporated by reference herein.

FIELD OF THE INVENTION

The present invention generally relates to extruding liquids and, more specifically, to extruding liquids from a slot nozzle.

BACKGROUND OF THE INVENTION

Currently, various manufacturing operations require the extrusion of thermoplastic liquids, such as hot melt adhesives, from slot-shaped openings in nozzles. For example, it may be desirable to lay down a thin film of adhesive on a moving substrate, such as a nonwoven material. The thin film of adhesive may have any desired width but, for example, one application requires a total width of 150 mm. In addition, it may also be desirable to have different add-on weights of adhesive along the length of the substrate as the substrate moves adjacent to the dispenser during the manufacturing operation. In one current design, a shim plate construction is used which includes three adjacent 50 mm slots to achieve a total dispensed adhesive width of 150 mm. Each 50 mm slot is fed by two separate on/off valve modules which receive pressurized liquid adhesive from two separate pumps. For example, a system such as the one disclosed in U.S. Pat. No. 6,422,428 may be used in this situation. The disclosure of U.S. Pat. No. 6,422,428 is hereby incorporated by reference herein. The difference between the system disclosed in U.S. Pat. No. 6,422,428 and the slot coating system just described is that a slot coating nozzle assembly extends across multiple valve modules as opposed to having a separate nozzle coupled to each module as shown in the patent.

In the current slot coating system, to achieve different add-on weights along the length of the dispensed film, one of the two valve modules feeding a 50 mm slot is cycled off and then on again. The other valve module feeding that slot remains on. While one of the two valve modules is off, a lesser amount of liquid should theoretically flow to the 50 mm slot and be discharged. This system, however, did not produce the desired results in that the patterns produced were not controllable in an acceptable manner and with the accuracy of the desired controllable and variable add-on weight of adhesive along the length of the substrate.

For these reasons, as well as others, it would be desirable to provide a dispensing system which allows accurate, individually metered output capability from a single extrusion location on a dispensing system.

SUMMARY OF INVENTION

The present invention generally provides a nozzle assembly adapted to be coupled to first and second valve modules which each have an output for delivering a liquid under pressure. The nozzle assembly includes two liquid inputs and at least two separated, at least partially coextensive outputs, which may be slots or other types of liquid outputs, respectively communicating independently with the two liquid inputs. The two liquid inputs are adapted to be coupled in communication with the outputs of the first and second valve modules.

A dispensing system is provided which includes the nozzle assembly described above, as well as at least first and second valve modules and, preferably, first and second pumps respectively coupled to the first and second valve modules for supplying the liquid independently to each valve module.

A method of extruding a liquid is provided comprising delivering the liquid to two separated, at least partially coextensive outputs of a nozzle assembly, discharging the liquid from the outputs, and combining the discharged liquid on a substrate. Also in accordance with the method, the discharge of liquid from each output may be separately controlled to vary the amount of liquid dispensed onto the substrate. This may be achieved, for example, by cycling one of the first and second valve modules on and off.

Benefits are achieved by the invention such as improved metering capability and improved, accurate add-on weight variability along the length of a dispensed liquid pattern. These and other objectives, advantages and features of the invention will become more readily apparent to those of ordinary skill in the art upon review of the following description of one preferred embodiment of the invention taken in conjunction with the accompanying drawings.

DETAILED DESCRIPTION

Figure 1:
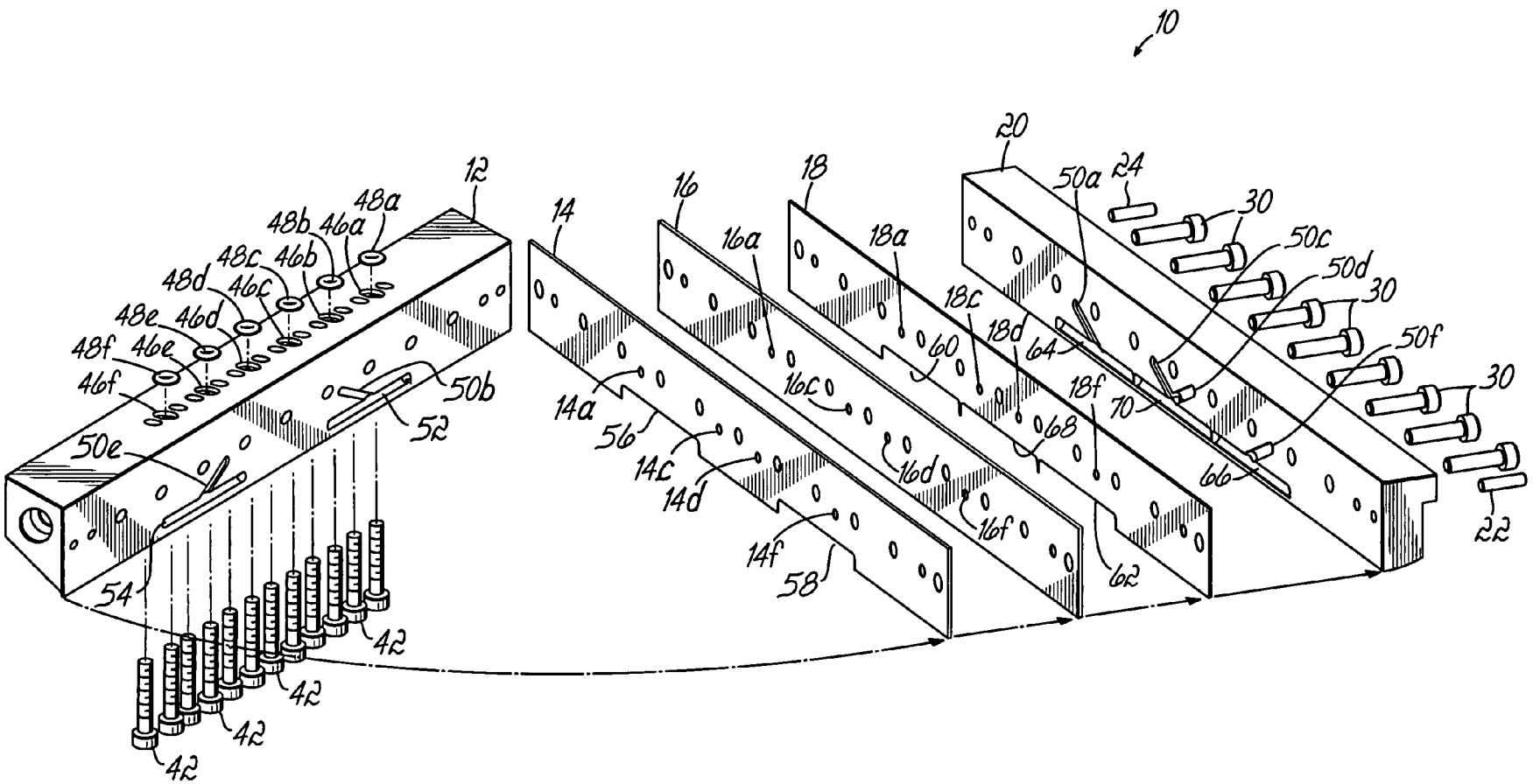
FIG. 1 is a disassembled perspective view of a nozzle assembly constructed in accordance with the preferred embodiment of the invention.
Figure 2:
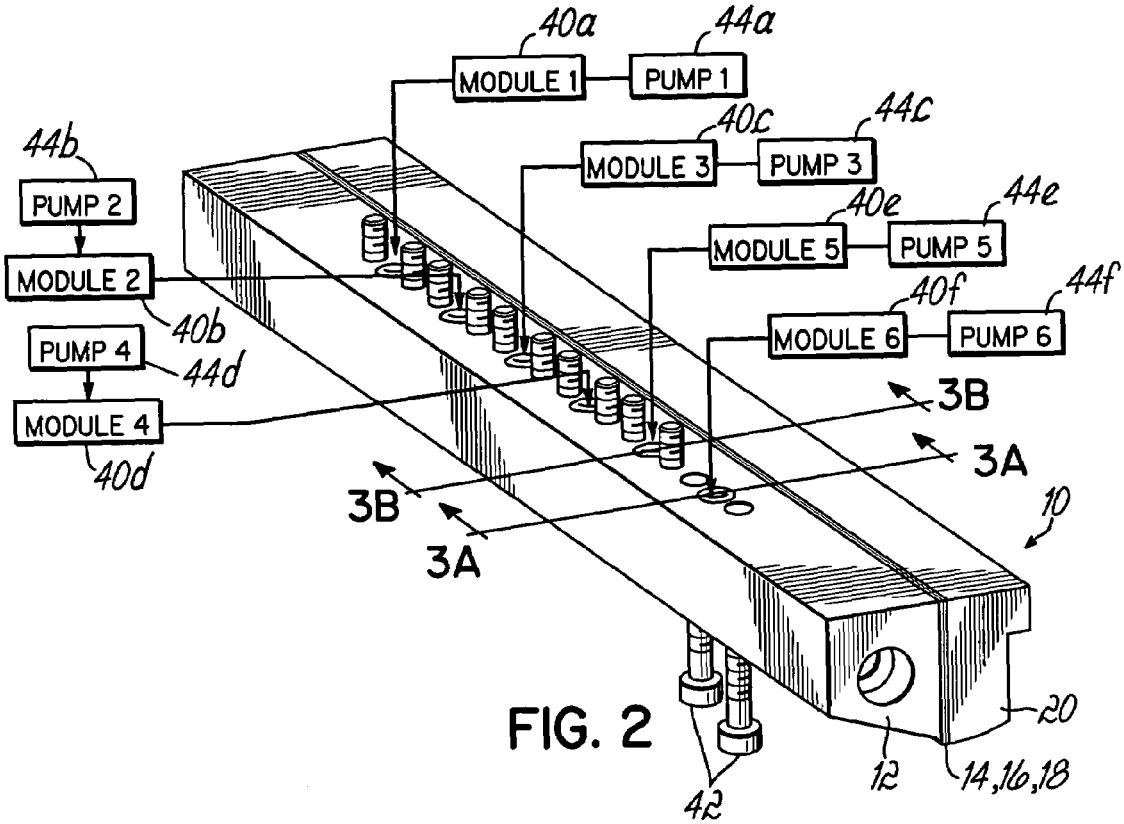
FIG. 2 is an assembled perspective view of the nozzle assembly shown in FIG. 1, and schematically illustrating coupling thereof to respective pumps and valve modules.

Referring first to FIGS. 1, 2, 5 and 6, a nozzle assembly 10 of the present invention is constructed from multiple elongate pieces including a mouthpiece adaptor portion 12, three shim plates 14, 16, 18, and a mouthpiece portion 20. These pieces 12, 14, 16, 18, 20 are properly aligned using alignment pins 22, 24 extending through respective holes and fastened together using threaded fasteners 30 extending through respective holes in mouthpiece portion 20 and shims 14, 16, 18 and threaded into internally threaded holes in mouthpiece adaptor portion 12. The resulting assembly 10 is fastened to a plurality of, in this case, six valve modules 40*a–f* (FIG. 2) using threaded fasteners 42. Each valve module 40*a–f* receives liquid under pressure from a separate and independently controllable pump 44*a–f* and dispenses the pressurized liquid into six respective liquid input ports 46*a–f* in nozzle mouthpiece adaptor portion 12. The liquid output (not shown) of each valve module 40*a–f* is sealed to mouthpiece adaptor portion by a respective O-ring 48*a–f*. Each liquid input 46*a–f* of mouthpiece adaptor portion 12 independently communicates with a separate input slot in either mouthpiece adaptor portion 12 (two separate input slots 50*b*, 50*e* communicating respectively with liquid inputs 46*b*, 46*e*) or nozzle mouthpiece portion 20 (four separate input slots 50*a*, 50*c*, 50*d*, 50*f* respectively communicating with liquid inputs 46*a*, 46*c*, 46*d*, 46*f* through respective holes (14*a*, 14*c*, 14*d*, 14*f*), (16*a*, 16*c*, 16*d*, 16*f*), (18*a*, 18*c*, 18*d*, 18*f*) in shim plates 14, 16, 18).

Input slots 50*b*, 50*c* in nozzle mouthpiece adaptor portion 12 communicate with elongate output slots 52, 54 and also with discharge cutouts 56, 58 formed in shim plate 14. Two additional coextensive discharge cutouts 60, 62 are formed in shim plate 18 and align with cutouts 56, 58 but are separated from the coextensive cutouts 56, 58 due to the presence of central shim plate 16. The two cutouts 60, 62 in shim plate 18 are fed by elongate output slots 64, 66 fed by input slots 50*a*, 50*f*. A central cutout 68 in shim plate 18 is fed by two modules 40*c*, 40*d* and input slots 50*c*, 50*d* communicating with a single elongate output slot 70 which is coextensive with cutout 68. It will be appreciated that this central dispensing zone may also be constructed similar to the two outer zones such that separate cutouts are provided in shims 14, 18 and separated by inner shim 16, and fed by separate modules.

Figure 4:
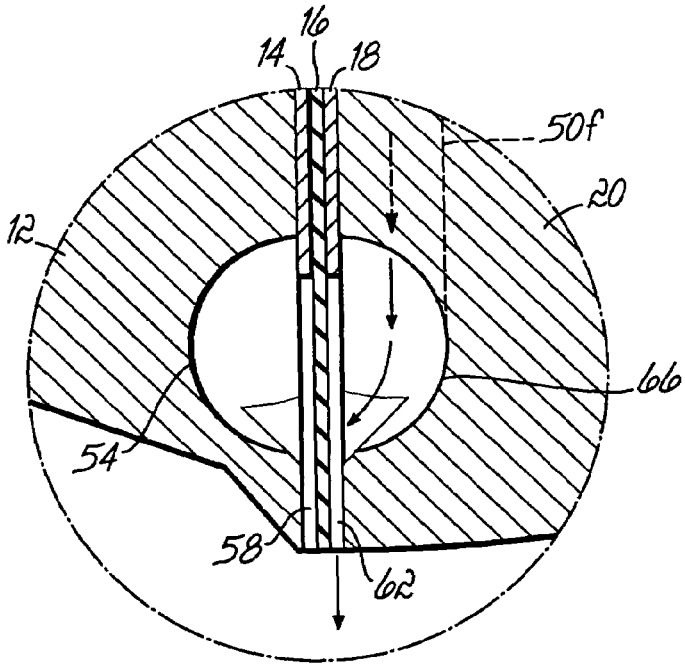
FIG. 4 is an enlarged cross sectional view of the output portion of the nozzle shown in FIG. 3A.
Figure 3A:
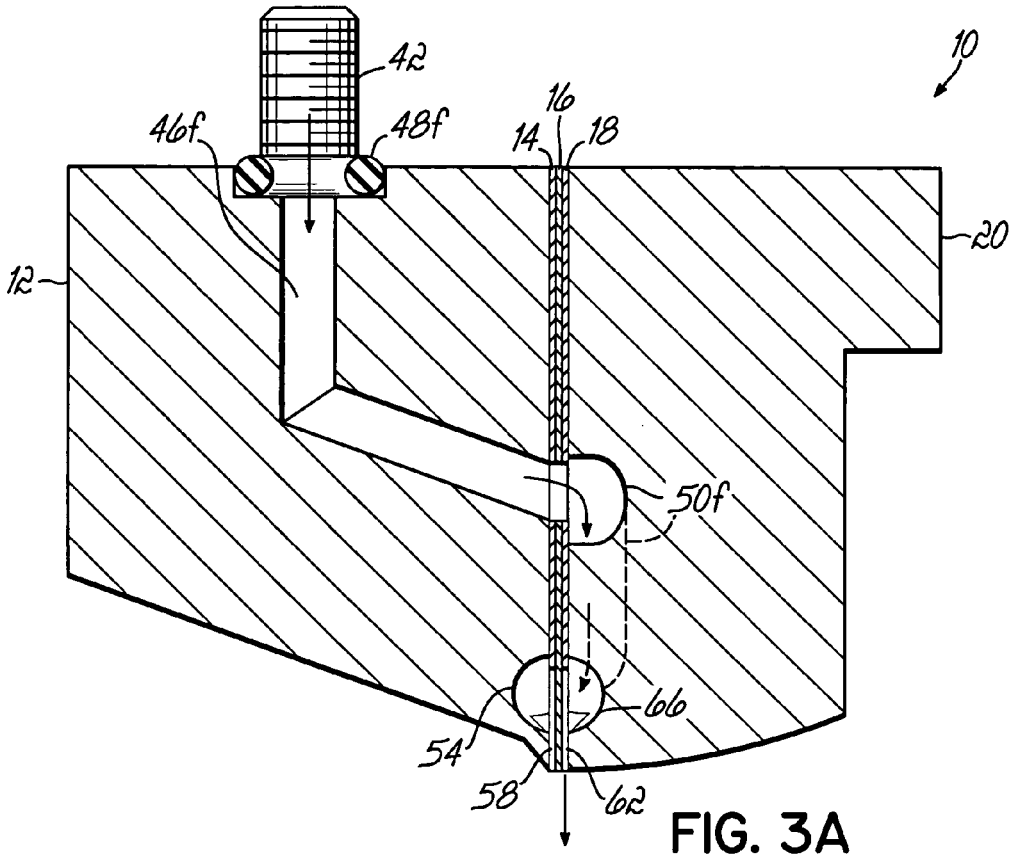
FIG. 3A is a cross sectional view taken along line 3A—3A of FIGS. 2, 5 and 6.
Figure 3B:
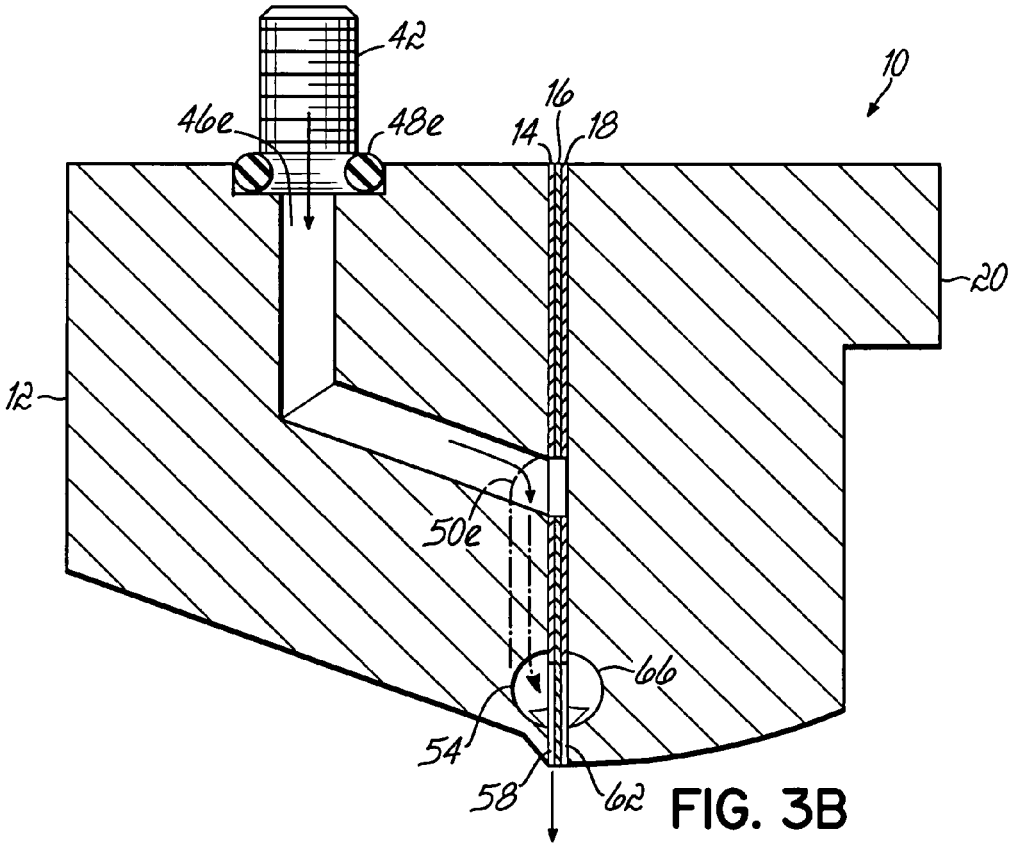
FIG. 3B is a cross sectional view taken along line 3B—3B of FIGS. 2, 5 and 6.
Figure 5:
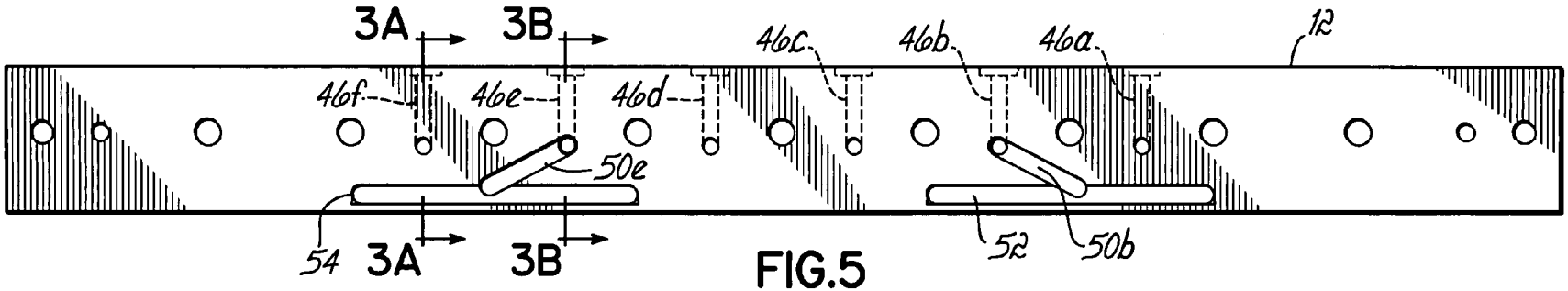
FIG. 5 is an elevational view of a mouthpiece adaptor portion of the nozzle assembly shown in FIG. 1.
Figure 6:
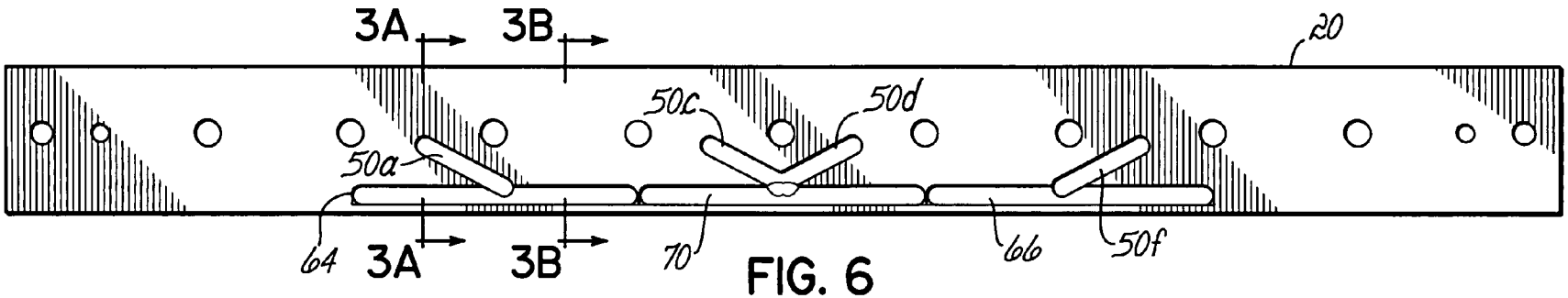
FIG. 6 is an elevational view of a mouthpiece portion of the nozzle assembly shown in FIG. 1.

Using arrows to denote liquid flow, FIGS. 3A, 3B and 4 illustrate how the liquid from input ports 46*e*, 46*f* and input slots 50*e*, 50*f* feed separate slot outputs defined by coextensive cutouts 58, 62. The liquid exits nozzle assembly 10 as separate extruded films which combine on a substrate (not shown). It will be appreciated that either module 40*e* or 40*f* (FIG. 2) may be cycled on or off to likewise cycle the dispensing of liquid from either of the outputs 58, 62 on or off and thereby lower the add-on weight of liquid in the dispensed film pattern for the time period that a module is shut off. Other methods of controlling the output of liquid, such as by varying the pump speed, may also be used for similar effects. It will also be appreciated that other types of outputs and resulting liquid patterns may also be utilized in accordance with the inventive concepts. Cutouts 56, 60 similarly receive liquid from input ports 46*b* and 46*a*, respectively, and are also separated by central or inner shim 16. Likewise, they are independently controlled by modules 40*b* and 40*a*.

While the present invention has been illustrated by a description of a preferred embodiment and while this embodiment has been described in considerable detail in order to describe the best mode of practicing the invention, it is not the intention of applicants to restrict or in any way limit the scope of the appended claims to such detail. Additional advantages and modifications within the spirit and scope of the invention will readily appear to those skilled in the art. The invention itself should only be defined by the appended claims.

We claim:

1. A dispensing system for dispensing a liquid onto a substrate moving in a machine direction, comprising:

first and second valve modules respectively including first and second inputs for receiving the liquid and first and second outputs for delivering the liquid under pressure; and a nozzle assembly in fluid communication with said first and second valve modules, said nozzle assembly comprising:

a first shim plate defining a first shim output in independent communication with said first liquid output of said first valve module, said first shim output adapted to discharge the liquid onto the substrate in a first pattern extending across at least a portion of the substrate in a cross-machine direction;

a second shim plate defining a second shim output in independent communication with said second liquid output of said second valve module, said second shim output adapted to discharge the liquid onto the substrate in a second pattern extending across at least a portion of the substrate in the cross-machine direction, said first shim output at least partially coextensive with said second shim output, said first and second shim outputs capable of selectively discharging the first and second patterns of liquid respectively onto the substrate such that one of the first and second patterns of liquid at least partially overlies the other of the first and second patterns of liquid.

2. The dispensing system of claim 1, further comprising first and second pumps respectively coupled to said first and second valve modules for supplying the liquid independently to each valve module, said pumps capable of adjusting liquid add-on weights of the first and second patterns of liquid.

3. The dispensing system of claim 1, wherein said first and second shim outputs are coextensive.

4. The dispensing system of claim 1, wherein said first and second shim outputs are each configured as a slot having a length in the cross-machine direction and a width in the machine direction, the length of the slot being greater than the width.

5. The dispensing system of claim 1, further comprising:

a third shim plate intermediate said first and second shim plates for separating said first and second shim outputs in the machine direction.

6. The dispensing system of claim 1, further comprising:

third and fourth valve modules respectively including third and fourth inputs for receiving the liquid and third and fourth outputs for delivering the liquid under pressure; and said nozzle assembly in fluid communication with said third and fourth valve modules and further comprising:

a third shim output in said first shim plate in independent communication with said third liquid output of said third valve module, said third shim output adapted to discharge the liquid onto the substrate in a third pattern extending across at least a portion of the substrate in the cross-machine direction;

a fourth shim output in said second shim plate in independent communication with said fourth liquid output of said fourth valve module, said fourth shim output adapted to discharge the liquid onto the substrate in a fourth pattern extending across at least a portion of the substrate in the cross-machine direction.

7. The dispensing system of claim 6, wherein said third and fourth shim outputs are each configured as a slot having a length in the cross-machine direction and a width in the machine direction, the length of the slot being greater than the width.

8. The dispensing system of claim 6, wherein said third shim output is at least partially coextensive with said fourth shim output, said third and fourth shim outputs capable of selectively discharging the third and fourth patterns of liquid respectively onto the substrate such that one of the third and fourth patterns of liquid at least partially overlies the other of the third and fourth patterns of liquid.

9. A nozzle assembly adapted to be in fluid communication with first and second valve modules for dispensing a liquid onto a substrate moving in a machine direction, the valve modules respectively including first and second inputs for receiving the liquid and first and second outputs for delivering the liquid under pressure, said nozzle assembly comprising:

a first shim plate defining a first shim output adapted to be in independent communication with the first liquid output of the first valve module, said first shim output adapted to discharge the liquid onto the substrate in a first pattern extending across at least a portion of the substrate in a cross-machine direction;

a second shim plate defining a second shim output adapted to be in independent communication with the second liquid output of the second valve module, said second shim output adapted to discharge the liquid onto the substrate in a second pattern extending across at least a portion of the substrate in the cross-machine direction, said first shim output at least partially coextensive with said second shim output, said first and second shim outputs capable of selectively discharging the first and second patterns of liquid respectively onto the substrate such that one of the first and second patterns of liquid at least partially overlies the other of the first and second patterns of liquid.

10. The nozzle assembly of claim 9, wherein said first and second shim outputs are coextensive.

11. The nozzle assembly of claim 9, wherein said first and second shim outputs are each configured as a slot having a length in the cross-machine direction and a width in the machine direction, the length of the slot being greater than the width.

12. The nozzle assembly of claim 9, further comprising:

a third shim plate intermediate said first and second shim plates for separating said first and second shim outputs in the machine direction.

13. A method of dispensing a liquid onto a substrate moving in a machine direction, comprising:

supplying the liquid to a first shim output in a first shim plate;

supplying the liquid to a second shim output in a second shim plate that is separated from the first shim output and at least partially coextensive with the first shim output;

independently controlling the flow of the liquid to both the first and second shim outputs;

discharging the liquid from the first shim output onto the substrate; and discharging the liquid from the second shim output onto the substrate so as to overlie at least a portion of the liquid from the first shim output.

14. The method of claim 13, further comprising:

separately controlling the discharge of liquid from each of the first and second shim outputs to vary the amount of liquid on the substrate.

15. The method of claim 13, wherein a first valve module supplies the liquid to the first shim output and a second valve module supplies the liquid to the second shim output, the method further comprising:

varying the output of the liquid from at least one of the first and second valve modules to control the flow of liquid to at least one of the first and second shim outputs.

16. The method of claim 15, wherein varying the output of the liquid from at least one of the first and second valve modules further comprises:

cycling at least one of the first and second valve modules on and off.

17. The method of claim 13, wherein a first valve module supplies the liquid to the first shim output and a second valve module supplies the liquid to the second shim output, each of the valve modules having a pump coupled thereto, the method further comprising:

varying the output of the liquid from at least one of the pumps to control the flow of liquid to at least one of the first and second shim outputs.

18. The method of claim 17, wherein varying the output from at least one of the pumps further comprises:

varying the speed of at least one of the pumps.

* * * * *